US009607546B2

(12) United States Patent
Kim

(10) Patent No.: US 9,607,546 B2
(45) Date of Patent: Mar. 28, 2017

(54) DISPLAY PANEL AND ORGANIC LIGHT EMITTING DISPLAY DEVICE HAVING THE SAME

(71) Applicant: Samsung Display Co., Ltd., Yongin, Gyeonggi-Do (KR)

(72) Inventor: Chang-Yeop Kim, Cheonan-si (KR)

(73) Assignee: Samsung Display Co., Ltd., Samsung-ro, Giheung-Gu, Yongin-si, Gyeonggi-Do (KR)

( * ) Notice: Subject to any disclaimer, the term of this patent is extended or adjusted under 35 U.S.C. 154(b) by 0 days.

(21) Appl. No.: 14/487,698

(22) Filed: Sep. 16, 2014

(65) Prior Publication Data

US 2015/0077413 A1 Mar. 19, 2015

(30) Foreign Application Priority Data

Sep. 17, 2013 (KR) ..... 10-2013-0112082

(51) Int. Cl.
*G09G 3/3233* (2016.01)
*G09G 3/3258* (2016.01)

(52) U.S. Cl.
CPC ..... *G09G 3/3233* (2013.01); *G09G 3/3258* (2013.01); *G09G 2300/0842* (2013.01);
(Continued)

(58) Field of Classification Search
CPC ..... G09G 3/3233; G09G 3/3258; G09G 2310/0256; G09G 2300/0219;
(Continued)

(56) References Cited

U.S. PATENT DOCUMENTS

2004/0017149 A1* 1/2004 Matsumoto ..... G09G 3/3233 313/500
2005/0243037 A1* 11/2005 Eom ..... G09G 3/3233 345/76

(Continued)

FOREIGN PATENT DOCUMENTS

JP 2010-217661 9/2010
KR 1020070052889 A 5/2007

(Continued)

OTHER PUBLICATIONS

"Capacitance" lecture published in farside,ph.utexas.edu as retrieved from the Wayback Machine as published in 2011.*

*Primary Examiner* — Liliana Cerullo
(74) *Attorney, Agent, or Firm* — Robert E. Bushnell, Esq.

(57) ABSTRACT

A display panel includes a plurality of pixel circuits. Each of pixel circuits comprises an emission unit including an organic light emitting diode, a pixel driving unit configured to drive an emission unit based on a scan signal and a data signal, and a switch unit configured to control an electrical connection between an emission unit and a pixel driving unit based on an emission signal. A first parasitic capacitance between an emission unit included in a first pixel circuit of pixel circuits and a pixel driving unit included in a first pixel circuit is smaller than a second parasitic capacitance between an emission unit included in a first pixel circuit and a pixel driving unit included in a second pixel circuit of pixel circuits adjacent to a first pixel circuit.

13 Claims, 16 Drawing Sheets

(52) U.S. Cl.
CPC ..... *G09G 2300/0852* (2013.01); *G09G 2300/0861* (2013.01); *G09G 2310/0256* (2013.01); *G09G 2320/0219* (2013.01)

(58) Field of Classification Search
CPC ... G09G 2300/0842; G09G 2300/0861; G09G 2300/0852; H01L 27/32–27/3223
See application file for complete search history.

(56) References Cited

U.S. PATENT DOCUMENTS

| | | | | |
|---|---|---|---|---|
| 2007/0115226 | A1 | 5/2007 | Jung et al. | |
| 2008/0042945 | A1* | 2/2008 | Mutsukura | G09G 3/3233 345/77 |
| 2010/0157177 | A1 | 6/2010 | Park et al. | |
| 2011/0101361 | A1* | 5/2011 | Von Werne | H01L 27/3265 257/59 |
| 2012/0105388 | A1 | 5/2012 | Han et al. | |
| 2012/0229437 | A1 | 9/2012 | Park et al. | |
| 2013/0201172 | A1 | 8/2013 | Jeong et al. | |

FOREIGN PATENT DOCUMENTS

| | | | |
|---|---|---|---|
| KR | 1020100071145 | A | 6/2010 |
| KR | 1020120044657 | A | 5/2012 |
| KR | 1020120103970 | A | 9/2012 |
| KR | 1020130091136 | A | 8/2013 |

* cited by examiner

DISPLAY PANEL AND ORGANIC LIGHT EMITTING DISPLAY DEVICE HAVING THE SAME

CLAIM OF PRIORITY

This application claims priority under 35 USC §119 to Korean Patent Applications No. 10-2013-0112082, filed on Sep. 17, 2013 in the Korean Intellectual Property Office (KIPO), the contents of which are incorporated herein in its entirety by reference.

BACKGROUND OF THE INVENTION

Field of the Invention

Embodiments of the present invention relate generally to a display device. More particularly, Embodiments of the present invention relate to a display panel, and an organic light emitting display device having the display panel.

Description of the Related Art

Recently, a flat panel display device having advantages such as light weight and small volume has been developed. An organic light emitting display device that is one of the flat panel display device displays an image using an organic light emitting diode that is a self-light-emitting device, and thus has advantages, such as wide viewing angle, quick response time, stability at low temperature, low power consumption, etc.

In general, a pixel circuit of the organic light emitting display device includes a plurality of transistors, a capacitor and an organic light emitting diode. The transistors and the capacitor apply a current to the organic light emitting diode in response to a data signal, a scan signal, etc., and the organic light emitting diode emits light based on the applied current.

There is a problem that the organic light emitting diode may emit light by a small amount of leakage current flowing through the organic light emitting diode even if a black data signal allowing the organic light emitting diode not to emit light is applied to the pixel circuit. Moreover, there is another problem that, if a voltage of an anode electrode of the organic light emitting diode is changed, a kickback voltage may occur, thereby affecting the data signal.

SUMMARY OF THE INVENTION

Some example embodiments provide a display panel of an organic light emitting display device.

Some example embodiments provide an organic light emitting display device.

According to some example embodiments, a display panel of an organic light emitting display device may include a plurality of pixel circuits. Each of the pixel circuits includes an emission unit including an organic light emitting diode, a pixel driving unit configured to drive the emission unit based on a scan signal and a data signal, and a switch unit configured to control an electrical connection between the emission unit and the pixel driving unit based on an emission signal. A first parasitic capacitance between the emission unit included in a first pixel circuit of the pixel circuits and the pixel driving unit included in the first pixel circuit is smaller than a second parasitic capacitance between the emission unit included in the first pixel circuit and the pixel driving unit included in a second pixel circuit of the pixel circuits adjacent to the first pixel circuit.

In example embodiments, an anode electrode of the organic light emitting diode included in the first pixel circuit may be disposed over the pixel driving unit included in the second pixel circuit. The first electrodes of the organic light emitting diodes of the emission units of the plurality of pixel circuits may be disposed spaced-apart from each other In example embodiments, the second pixel circuit may be located in a first direction from the first pixel circuit, and the first direction is opposite to a direction in which the scan signal is sequentially applied to scan lines.

In example embodiments, the second pixel circuit may be located in a second direction from the first pixel circuit, and the second direction is a direction in which the scan signal is sequentially applied to scan lines.

In example embodiments, the emission unit may comprise the organic light emitting diode having a first electrode coupled to the switch unit, and a second electrode coupled to a first power supply voltage, a first transistor having a gate electrode receiving the scan signal, a first electrode coupled to the first electrode of the organic light emitting diode, and a second electrode coupled to a bias voltage, and a first capacitor having a first electrode coupled to the first electrode of the organic light emitting diode, and a second electrode coupled to the second electrode of the organic light emitting diode.

In example embodiments, the first transistor may apply the bias voltage to the first electrode of the organic light emitting diode during a turn-on period of the scan signal.

In example embodiments, the first capacitor may store the bias voltage applied to the first electrode of the organic light emitting diode during the turn-on period of the scan signal.

In example embodiments, if the data signal representing a black gray level is applied to the pixel driving unit during the turn-on period of the scan signal, the emission unit may allow a current leaked from the pixel driving unit to flow through the first transistor during a turn-on period of the emission signal.

In example embodiments, the bias voltage may have a voltage level set for the organic light emitting diode not to emit light by the leaked current during the turn-on period of the emission signal.

In example embodiments, the switch unit may comprise a second transistor having a gate electrode receiving the emission signal, a first electrode coupled to the pixel diving unit, and a second electrode coupled to the emission unit.

In example embodiments, the first capacitor may store the bias voltage when the second transistor electrically separates the emission unit from the pixel driving unit during a turn-off period of the emission signal.

In example embodiments, the pixel driving unit may comprise a second capacitor having a first electrode coupled to a second power supply voltage, and a second electrode, a third transistor having a gate electrode coupled to the second electrode of the second capacitor, a first electrode coupled to the second power supply voltage, and the second electrode coupled to the switch unit, and a fourth transistor having a gate electrode receiving the scan signal, a first electrode receiving the data signal, and a second electrode coupled to the gate electrode of the third transistor.

In example embodiments, the first parasitic capacitance may be a parasitic capacitance formed between the first electrode of the organic light emitting diode included in the first pixel circuit and the gate electrode of the third transistor included in the first pixel circuit, and the second parasitic capacitance is a parasitic capacitance formed between the first electrode of the organic light emitting diode included in the first pixel circuit and the gate electrode of the third transistor included in the second pixel circuit.

In example embodiments, the fourth transistor may apply the data signal to the second electrode of the second capacitor during a turn-on period of the scan signal, and the second capacitor may store the applied data signal.

In example embodiments, the third transistor may control an electrical connection between the second power supply voltage and the switch unit based on the data signal stored in the second capacitor during a turn-on period of the emission signal, and the organic light emitting diode may emit light based on the second power supply voltage supplied via the third transistor and the switch unit.

In example embodiments, the third transistor may control a magnitude of a current provided to the emission unit based on the data signal stored in the second capacitor during a turn-on period of the emission signal.

In example embodiments, the pixel driving unit may comprise a current source configured to supply an emission current, the current source having a first electrode coupled to the second power supply voltage and a second electrode, and a first electrode of the third transistor may be coupled to the second electrode of the current source.

In example embodiments, the third transistor may control an electrical connection between the current source and the switch unit based on the data signal stored in the second capacitor during a turn-on period of the emission signal, and the organic light emitting diode may emit light based on the emission current supplied via the third transistor and the switch unit.

According to some example embodiments, an organic light emitting display device includes a display panel including a plurality of pixel circuits, a scan driver configured to apply a scan signal to the pixel circuits, an emission driver configured to apply an emission signal to the pixel circuits, a data driver configured to apply a data signal to the pixel circuits, and a timing controller configured to control the scan driver, the emission driver, and the data driver. Each of the pixel circuits includes an emission unit including an organic light emitting diode, a pixel driving unit configured to drive the emission unit based on the scan signal and the data signal, and a switch unit configured to control an electrical connection between the emission unit and the pixel driving unit based on the emission signal. A first parasitic capacitance between the emission unit included in a first pixel circuit of the pixel circuits and the pixel driving unit included in the first pixel circuit, may be smaller than a second parasitic capacitance between the emission unit included in the first pixel circuit and the pixel driving unit included in a second pixel circuit of the pixel circuits adjacent to the first pixel circuit.

In example embodiments, an anode electrode of the organic light emitting diode included in the first pixel circuit may be disposed over the pixel driving unit included in the second pixel circuit.

According to some example embodiments, an organic light emitting display device may include a plurality of pixel circuits formed on a major surface of a substrate. Each pixel circuit may include a light emitting device including a first electrode, a second electrode, and an organic light emitting layer interposed between the first electrode and the second electrode. Each pixel circuit may also include a pixel driving unit electrically connected to the first electrode of the same pixel circuit and controlling emission of the light emitting device of the same pixel circuit. Each pixel driving unit may include a plurality of transistors and at least one capacitor that control the emission of the light emitting device of the same pixel. The first electrodes of the light emitting devices of the plurality of pixel circuits may be disposed spaced-apart from each other. A majority of the first electrode of the light emitting device of each pixel circuit may not overlap the pixel driving unit of said each pixel circuit.

According to some example embodiments, the first electrode of the light emitting device of each pixel may not overlap the pixel driving unit of said each pixel circuit.

According to some example embodiments, an area overlapped by the first electrode of the light emitting device of each pixel circuit and the pixel driving unit of said each pixel circuit may be smaller than an area overlapped by the first electrode of the light emitting device of said each pixel circuit and the pixel driving unit of another pixel circuit adjacent to said pixel circuit.

According to some example embodiments, each pixel circuit further may comprise a switch including first, second, and third terminals, the first terminal of the switch electrically connected the first electrode of the light emitting device of the same pixel circuit, the second terminal of the switch electrically connected to the pixel driving unit of the same pixel circuit, and the third terminal of the switch turning on or off a current flowing between the first and second terminals upon a signal applied to the third terminal. Therefore, a display panel of an organic light emitting display device and an organic light emitting display device according to example embodiments may allow an organic light emitting diode not to emit light when a black data signal is applied, and may minimize an influence of a kickback voltage without an extra scan signal since an emission unit of a pixel circuit forms a parasitic capacitance with a pixel driving unit of an adjacent pixel circuit. As a result, a contrast may be improved, a high-resolution may be implemented, and a power supply voltage may be changed to improve power consumption.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE EMBODIMENTS

Figure 1:
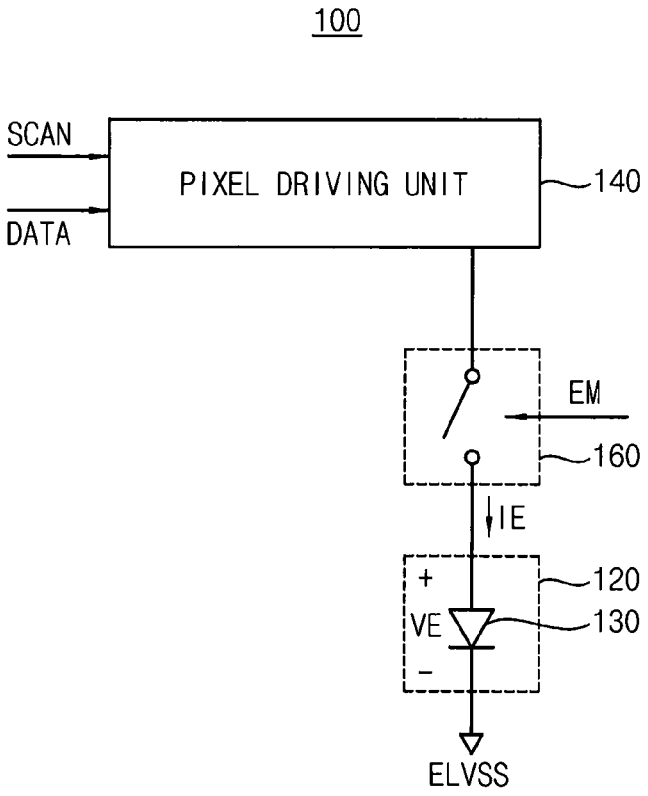
FIG. 1 is a block diagram illustrating a pixel circuit included in a display panel of an organic light emitting display device according to example embodiments.

Various example embodiments will be described more fully hereinafter with reference to the accompanying drawings, in which some example embodiments are shown. The present inventive concept may, however, be embodied in many different forms and should not be construed as limited to the example embodiments set fourth herein. Rather, these example embodiments are provided so that this disclosure will be thorough and complete, and will fully convey the scope of the present inventive concept to those skilled in the art. In the drawings, the sizes and relative sizes of layers and regions may be exaggerated for clarity. Like numerals refer to like elements throughout.

It will be understood that, although the terms first, second, third etc. may be used herein to describe various elements, these elements should not be limited by these terms. These terms are used to distinguish one element from another. Thus, a first element discussed below could be termed a second element without departing from the teachings of the present inventive concept. As used herein, the term "and/or" includes any and all combinations of one or more of the associated listed items.

It will be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular example embodiments only and is not intended to be limiting of the present inventive concept. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this inventive concept belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a block diagram illustrating a pixel circuit included in a display panel of an organic light emitting display device according to example embodiments.

Referring to FIG. 1, a pixel circuit 100 included in a display panel of an organic light emitting display device may include an emission unit 120, a pixel driving unit 140, and a switch unit 160. An organic light emitting diode 130 included in the emission unit 120 may not emit light when a black data signal is applied.

The emission unit 120 may emit light based on an emission current IE applied to the emission unit 120, or may emit light based on the emission current IE generated by an emission voltage VE applied to the emission unit 120. The emission unit 120 may include the organic light emitting diode 130. The organic light emitting diode 130 may be coupled to a first power supply voltage ELVSS. The organic light emitting diode 130 may emit light based on a recombination of the holes and electrons caused by the emission current IE flowing through the organic light emitting diode 130.

The pixel driving unit 140 may drive the emission unit 120 by supplying the emission current IE or the emission voltage VE to the emission unit 120 based on a scan signal SCAN and a data signal DATA. A time point at which the data signal DATA is applied to the pixel driving unit 140 may be controlled based on the scan signal SCAN. The data signal DATA applied to the pixel driving unit 140 may have information of the emission current IE or the emission voltage VE to be supplied to the emission unit 120. The pixel driving unit 140 may determine whether to supply the emission current IE or the emission voltage VE to the emission unit 120 and/or may determine a magnitude of the supplied emission current IE or emission voltage VE based on information of the data signal DATA.

The switch unit 160 may control an electrical connection between the emission unit 120 and the pixel driving unit 140 based on an emission signal EM. For example, the switch unit 160 may electrically couple the pixel driving unit 140 to the emission unit 120 while the pixel driving unit 140 supplies the emission current IE or the emission voltage VE to the pixel driving unit 140, and may electrically decouple the pixel driving unit 140 from the emission unit 120 while the pixel driving unit 140 does not supply the emission current IE or the emission voltage VE to the pixel driving unit 140.

Figure 2:
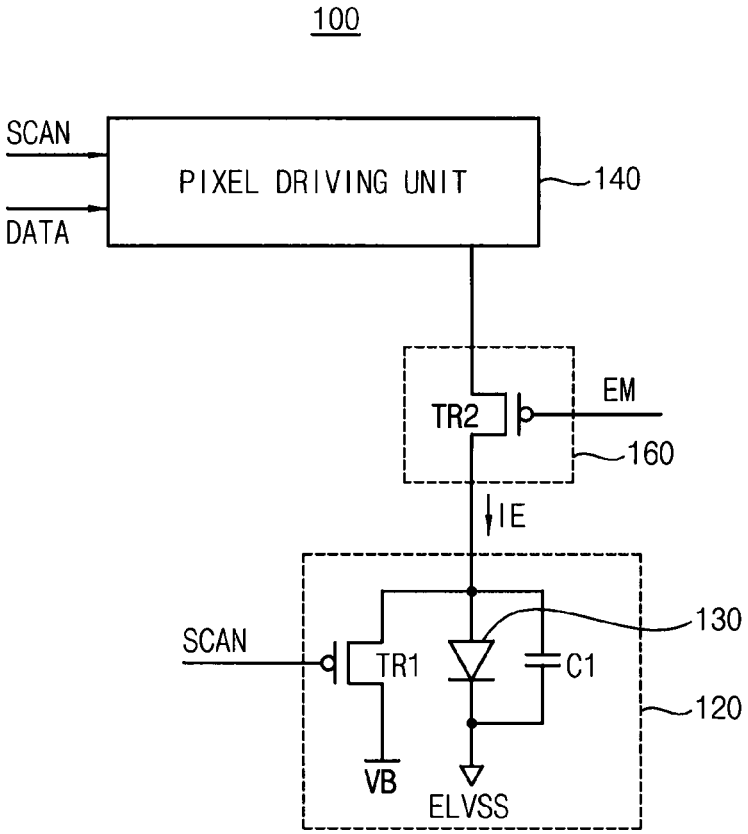
FIG. 2 is a circuit diagram illustrating an example of an emission unit and a switch unit included in a pixel circuit of FIG. 1.

FIG. 2 is a circuit diagram illustrating an example of an emission unit and a switch unit included in a pixel circuit of FIG. 1.

Referring to FIG. 2, an emission unit 120 may include an organic light emitting diode 130, a first transistor TR1, and a first capacitor C1, and a switch unit 160 may include a second transistor TR2.

A first electrode (e.g. an anode electrode) of the organic light emitting diode 130 may be coupled to the switch unit 160, and a second electrode (e.g. a cathode electrode) of the organic light emitting diode 130 may be coupled to a first power supply voltage ELVSS. The organic light emitting diode 130 may emit light based on a recombination of the holes and electrons caused by an emission current IE flowing through the organic light emitting diode 130.

The first transistor TR1 may have a gate electrode receiving a scan signal SCAN, a first electrode coupled to the anode electrode of the organic light emitting diode 130, and a second electrode coupled to a bias voltage VB. The first transistor TR1 may apply the bias voltage VB to the anode electrode of the organic light emitting diode 130 during a turn-on period of the scan signal SCAN.

The first capacitor C1 may have a first electrode coupled to the anode electrode of the organic light emitting diode 130, and a second electrode coupled to the cathode electrode of the organic light emitting diode 130. The first capacitor C1 may initialize a voltage difference between the anode electrode and the cathode electrode of the organic light emitting diode 130 as an initial value (e.g., VB−ELVSS) by storing the bias voltage VB applied to the anode electrode of the organic light emitting diode 130 during the turn-on period of the scan signal SCAN. In addition, the emission current IE may flow through the first capacitor C1 during a portion of a turn-on period of an emission signal EM until the voltage difference having the initial value (e.g., VB−ELVSS) reaches a threshold voltage of the organic light emitting diode 130.

The second transistor TR2 may electrically separate the emission unit 120 from a pixel driving unit 140 during a turn-off period of the emission signal EM to initialize the anode electrode of the organic light emitting diode 130 as the bias voltage VB, and may electrically connect the emission unit 120 to the pixel driving unit 140 during the turn-on period of the emission signal EM to allow the emission unit 120 to emit light. To achieve the initialization, the turn-off period of the emission signal EM may at least partially overlap the turn-on period of the scan signal SCAN.

A voltage level of the first power supply voltage ELVSS may be changed to reduce power consumption. Even if the emission current IE leaks into the emission unit 120 when the data signal DATA representing a black gray level is applied to the pixel driving unit 140, the bias voltage VB may be set for the organic light emitting diode 130 not to emit light.

For example, assuming that the emission current IE that leaks during the turn-on period of the emission signal EM is constant, the bias voltage VB may be set according to following [equation 1] when the data signal DATA representing a black gray level is applied to the pixel driving unit 140.

$$VB \leq VEL + ELVSS - \frac{IE \times T}{C_1} \quad \text{[Equation 1]}$$

Here, VEL represents the threshold voltage of the organic light emitting diode 130, IE represents the leaking emission current, T represents an emission time, and C1 represents the capacitance of the first capacitor C1.

Figure 3A:
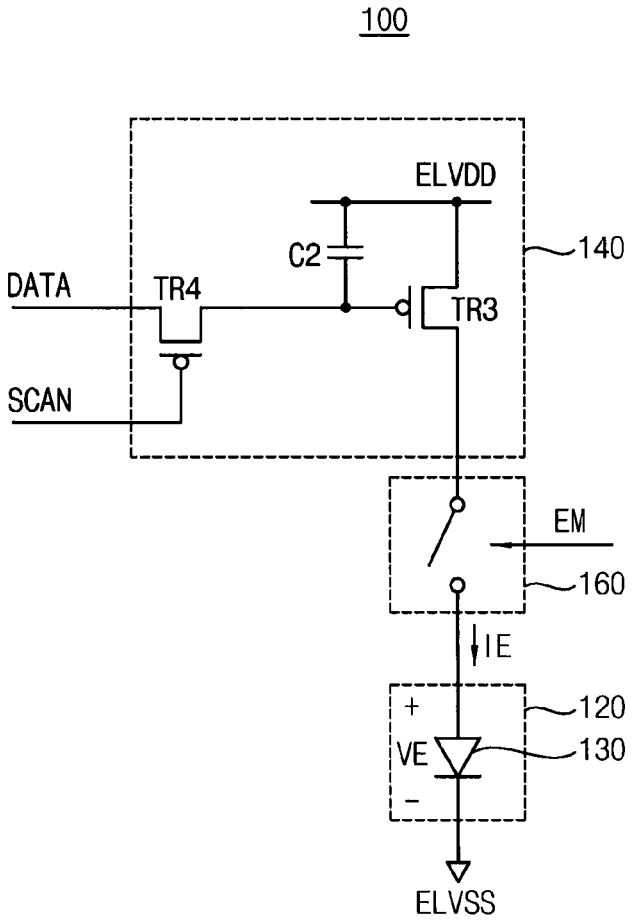
FIG. 3A is a circuit diagram illustrating an example of a pixel driving unit included in a pixel circuit of FIG. 1.

FIG. 3A is a circuit diagram illustrating an example of a pixel driving unit in a pixel circuit of FIG. 1.

Referring to FIG. 3A, a pixel driving unit 140 included in a pixel circuit 100 may include a second capacitor C2, a third transistor TR3, and a fourth transistor TR4. The pixel driving unit 140 may drive an emission unit 120 with an analog driving method, a digital driving method, or the like. For example, the analog driving method may represent a gray level by controlling a magnitude of the emission current IE applied to an organic light emitting diode 130 based on a data signal DATA applied to the pixel driving unit 140. In the digital driving method, the organic light emitting diode 130 may receive the emission voltage VE having a fixed magnitude, and a gray level may be represented by controlling an emission time of the organic light emitting diode 130 based on the data signal DATA applied to the pixel driving unit 140.

The data signal DATA may be applied to a second electrode of the second capacitor C2 during a turn-on period of a scan signal SCAN. The second capacitor C2 may store the applied data signal DATA. The applied data signal DATA may be maintained during a turn-off period of the scan signal SCAN. In case of the analog driving method, the third transistor TR3 may operate in a saturation region, and may supply the emission current IE to the emission unit 120 based on the stored data signal DATA during a turn-on period of an emission signal EM. In case of the digital driving method, the third transistor TR3 may operate in a linear region, and may determine whether to supply a second power supply voltage ELVDD to the emission unit 120 as the emission voltage VE based on the stored data signal DATA during the turn-on period of the emission signal EM. Based on the supplied emission voltage VE, the emission current IE flowing through the organic light emitting diode 130 may be generated.

Figure 3B:
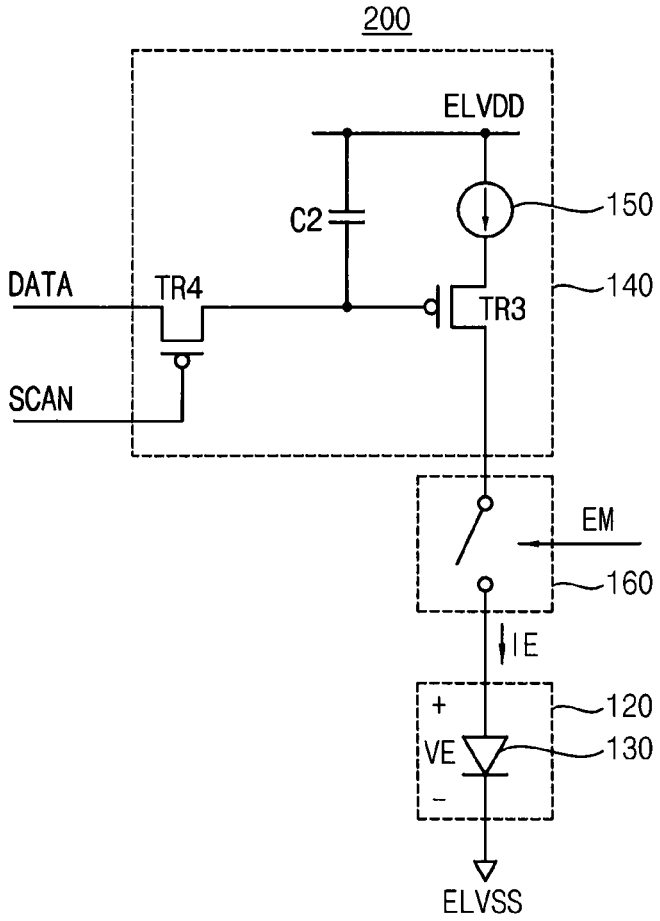
FIG. 3B is a circuit diagram illustrating another example of a pixel driving unit included in a pixel circuit of FIG. 1.

FIG. 3B is a circuit diagram illustrating another example of a pixel driving unit included in a pixel circuit of FIG. 1.

Referring to FIG. 3B, a pixel driving unit 140 included in a pixel circuit 200 may include a second capacitor C2, a third transistor TR3, a fourth transistor TR4, and a current source 150. Using the digital driving method, the pixel driving unit 140 may represent a gray level by controlling an emission time of an organic light emitting diode 130 based on a data signal DATA applied to the pixel driving unit 140. However, unlike the typical digital driving method, the organic light emitting diode 130 may receive an emission current IE having a fixed magnitude from the current source 150.

The data signal DATA may be applied to a second electrode of the second capacitor C2 during a turn-on period of a scan signal SCAN, and the second capacitor C2 may store the applied data signal DATA. The stored data signal DATA may be maintained during a turn-off period of the scan signal SCAN. The third transistor TR3 may operate in a linear region, and may determine whether to supply a current determined by the current source 150 to an emission unit 120 as the emission current IE based on the stored data signal DATA during a turn-on period of an emission signal EM.

Figure 4:
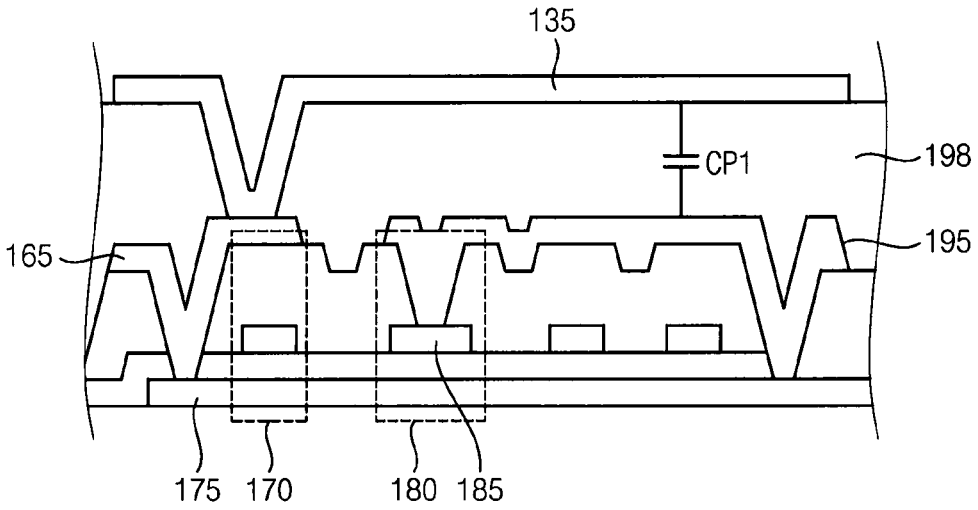
FIG. 4 is a cross-sectional diagram illustrating an example where a parasitic capacitance of a pixel circuit is formed within the pixel circuit in a display panel of an organic light emitting display device.

FIG. 4 is a cross-sectional diagram illustrating an example where a parasitic capacitance of a pixel circuit is formed within the pixel circuit in a display panel of an organic light emitting display device.

FIG. 4 illustrates a contemporary pixel circuit. In FIG. 4, an anode electrode 135 of an organic light emitting diode, a second transistor 170, and a third transistor 180 are illustrated.

The anode electrode 135 of the organic light emitting diode may be connected to a second electrode 165 of the second transistor 170, and may be connected to the third transistor 180 via a semiconductor layer 175. An electrode 195 may be connected to a gate electrode 185 of the third transistor 180, and the electrode 195 in the pixel circuit may form a parasitic capacitor CP1 with the anode electrode 135 and an insulating layer 198 interposed between the anode electrode 135 and the electrode 195 in the same pixel circuit.

The detailed impacts of the parasitic capacitor CP1 will be discussed with reference to CP1_1, CP1_2, and CP1_3 shown in FIG. 5. Although not shown in FIG. 4, the organic light emitting diode may also include a cathode electrode and an organic light emitting layer interposed between the anode electrode 135 and the cathode electrode.

Figure 5:
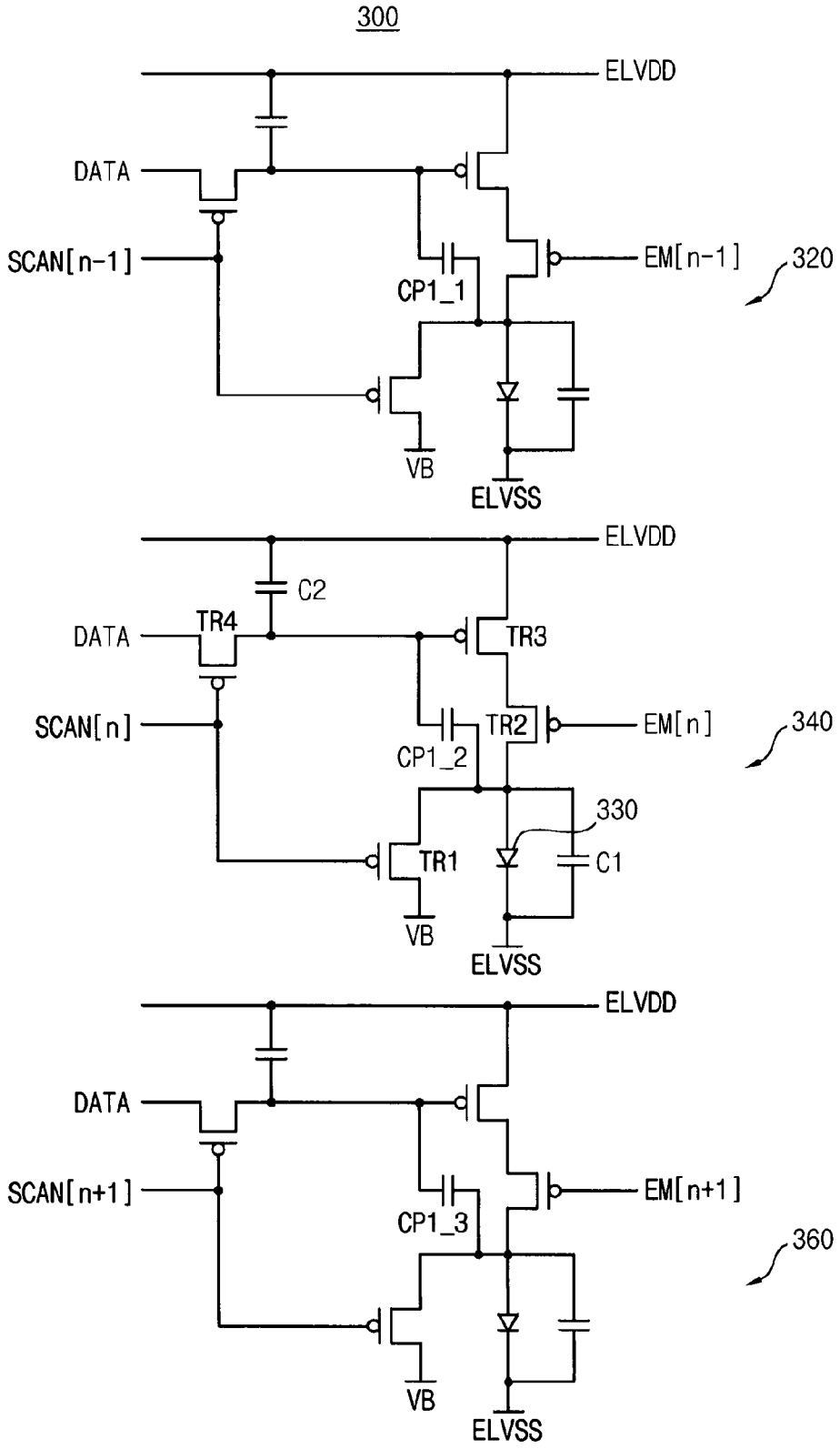
FIG. 5 is a circuit diagram illustrating an example where a kickback voltage is generated in a pixel circuit of FIG. 4.

FIG. 5 is a circuit diagram illustrating an example where a kickback voltage is generated in a pixel circuit of FIG. 4.

Referring to FIG. 5, a display panel 300 of an organic light emitting display device may include a pixel circuit 320 coupled to an (n−1)th scan line, a pixel circuit 340 coupled to an nth scan line, and a pixel circuit 360 coupled to an (n+1)th scan line. Each pixel circuit 320, 340, and 360 may have a parasitic capacitor CP1_1, CP1_2, and CP1_3 within the pixel circuit as illustrated in FIG. 4. When a voltage of an anode electrode of an organic light emitting diode 330 is changed, a kickback voltage may be generated due to such a parasitic capacitor CP1_2 according to following [equation 2], which results in a change of a voltage of a gate electrode of a third transistor TR3. In other words, the more the voltage of the anode electrode of the organic light emitting diode 330 varies, the more kickback voltage may be generated.

$$VK = \frac{CP_{1_2}}{C_2 + CP_{1_2}} \times \Delta VA \qquad \text{[Equation 2]}$$

Here, VK represents the kickback voltage, ΔVA represents a voltage variation of the anode electrode, $C_2$ represents the capacitance of the second capacitor C2, and $CP_{1_2}$ represents the capacitance of the parasitic capacitor CP1_2.

For example, when the voltage of the anode electrode of the organic light emitting diode 330 rapidly increases (e.g., from VB to ELVSS+VEL) at a starting point of a turn-on period of an emission signal EM, the kickback voltage according to the [equation 2] may be generated by the parasitic capacitor CP1_2, and the voltage of the gate electrode of the third transistor TR3 may be increased due to the kickback voltage. Accordingly, a data signal DATA having a sufficiently low voltage for representing a white gray level cannot be implemented.

Figure 6:
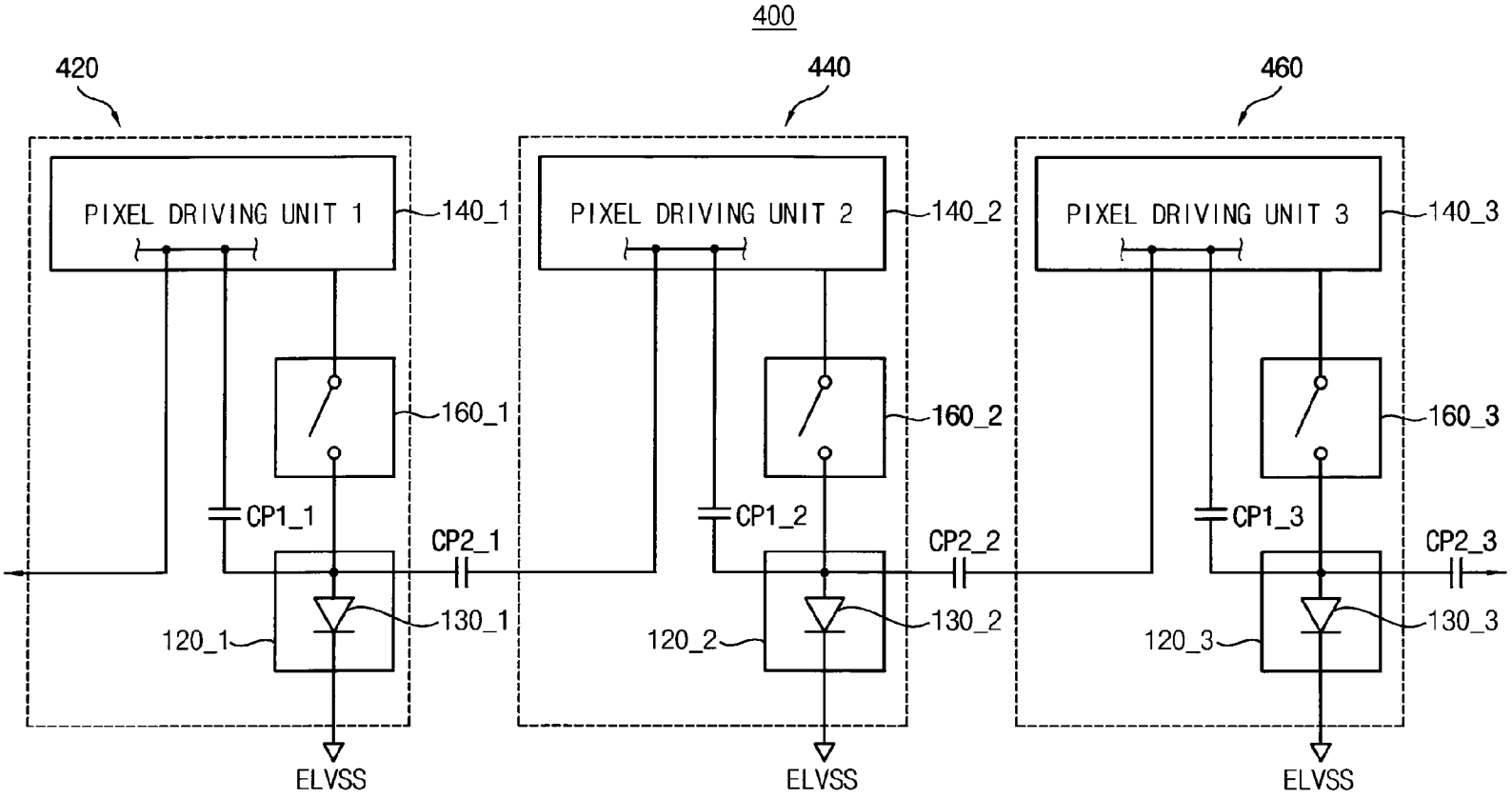
FIG. 6 is a block diagram illustrating a display panel of an organic light emitting display device according to example embodiments.

FIG. 6 is a block diagram illustrating a display panel according to example embodiments.

Referring to FIG. 6, a display panel 400 of an organic light emitting display device is illustrated. The display panel may minimize an influence of a kickback voltage on a data signal DATA. The display panel 400 of the organic light emitting display device may include a first pixel circuit 420, a second pixel circuit 440, and a third pixel circuit 460 which are adjacent to each other. The first pixel circuit 420 may include a first emission unit 120_1, a first pixel driving unit 140_1, and a first switch unit 160_1. The second pixel circuit 440 may include a second emission unit 120_2, a second pixel driving unit 140_2, and a second switch unit 160_2. The third pixel circuit 460 may include a third emission unit 120_3, a third pixel driving unit 140_3, and a third switch unit 160_3. The first emission unit 120_1 may include a first organic light emitting diode 130_1 as an emission device, the second emission unit 120_2 may include a second organic light emitting diode 130_2 as an emission device, and the third emission unit 120_3 may include a third organic light emitting diode 130_3 as an emission device. An anode electrode of the first organic light emitting diode 130_1 may form a first parasitic capacitance CP1_1 with any electrode of the first pixel driving unit 140_1, and may form a second parasitic capacitance CP2_2 with any electrode of the second pixel driving unit 140_2. An anode electrode of the second organic light emitting diode 130_2 may form a first parasitic capacitance CP1_2 with any electrode of the second pixel driving unit 140_2, and may form a second parasitic capacitance CP2_2 with any electrode of the third pixel driving unit 140_3. An anode electrode of the third organic light emitting diode 130_3 may form a first parasitic capacitance CP1_3 with any electrode of the third pixel driving unit 140_3, and may form a second parasitic capacitance CP2_3 with any electrode of a fourth pixel driving unit (not shown) of a fourth pixel circuit (not shown) which is adjacent to the third pixel circuit 460.

The capacitance of each of the first parasitic capacitors CP1_1, CP1_2, and CP1_3 may be smaller than the respective capacitance of the second parasitic capacitors CP2_1, CP2_2, and CP2_3. In particular, the first organic light emitting diode 130_1 may be relatively distant from the first pixel driving unit 140_1, and may be located in the vicinity of the second pixel driving unit 140_2. The second organic light emitting diode 130_2 may be relatively distant from the second pixel driving unit 140_2, and may be located in the vicinity of the third pixel driving unit 140_3. The third organic light emitting diode 130_3 may be relatively distant from the third pixel driving unit 140_3, and may be located in the vicinity of the fourth pixel driving unit (not shown). Accordingly, since an amount of a parasitic capacitance is in inverse proportion to a distance between electrodes of the parasitic capacitor, the capacitance of the first parasitic capacitor CP1_1 between the first organic light emitting diode 130_1 and the first pixel driving unit 140_1 may be smaller than the capacitance of the second parasitic capacitor CP2_1 between the first organic light emitting diode 130_1 and the second pixel driving unit 140_2, the capacitance of the first parasitic capacitor CP1_2 between the second organic light emitting diode 130_2 and the second pixel driving unit 140_2 may be smaller than the capacitance of the second parasitic capacitor CP2_2 between the second organic light emitting diode 130_2 and the third pixel driving unit 140_3, and the capacitance of the first parasitic capacitor CP1_3 between the third organic light emitting diode 130_3 and the third pixel driving unit 140_3 may be smaller than the capacitance of the second parasitic capacitor CP2_3 between the third organic light emitting diode 130_3 and the fourth pixel driving unit (not shown).

In some example embodiments, the first pixel circuit 420 may be a pixel circuit located in a first direction from the first pixel circuit 440, and the first direction may be opposite to a direction in which a scan signal SCAN is sequentially applied to scan lines. In other example embodiments, the second pixel circuit may be a pixel circuit located in a second direction from the first pixel circuit, and the second direction may be a direction in which the scan signal is sequentially applied to scan lines.

Figure 7:
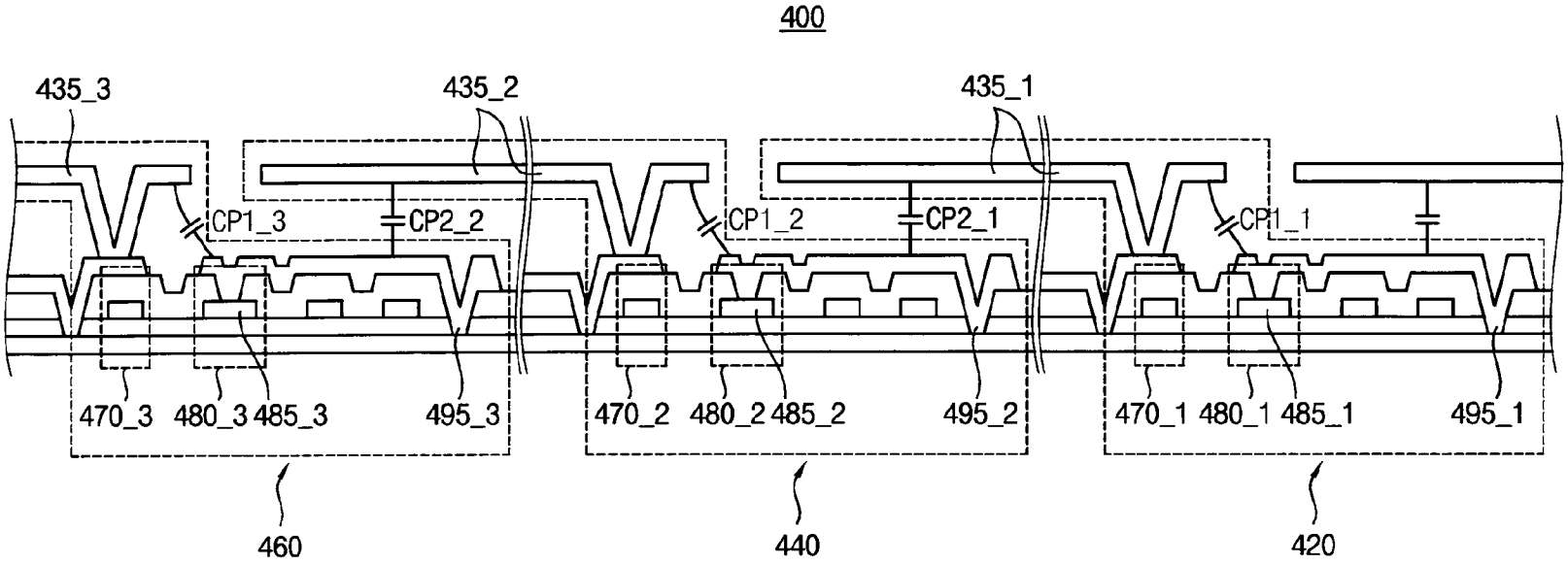
FIG. 7 is a cross-sectional diagram illustrating an example where a parasitic capacitance of a pixel circuit is formed with an adjacent pixel circuit included in a display panel of an organic light emitting display device of FIG. 6.

FIG. 7 is a cross-sectional diagram illustrating an example where a parasitic capacitance of a pixel circuit is formed with an adjacent pixel circuit in a display panel of an organic light emitting display device of FIG. 6.

Referring to FIG. 7, a display panel 400 of an organic light emitting display device may include first, second, and third pixel circuits 420, 440, and 460 being adjacent to each other. The first, second, and third pixel circuits 420, 440, and 460 may be formed on a major surface of a substrate (not shown). Anode electrodes 435_1, 435_2, and 435_3 of organic light emitting diodes, second transistors 470_1, 470_2, and 470_3, and third transistors 480_1, 480_2, and 480_3 are illustrated. The electrode 495_1 included in the first pixel circuit 420 may be connected to a gate electrode 485_1 of the third transistor 480_1 included in the first pixel circuit 420, the electrode 495_2 included in the second pixel circuit 440 may be connected to a gate electrode 485_2 of the third transistor 480_2 included in the second pixel circuit 440, and the electrode 495_3 included in the third pixel circuit 460 may be connected to a gate electrode 485_3 of the third transistor 480_3 included in the third pixel circuit 460. Although not shown in FIG. 7, the display panel 400 may include an insulating layer interposed between the anode electrodes 425_1, 435_2, and 435_3 and the electrodes 495_1, 495_2, and 495_3. Because the configurations of the second transistors 470_1, 470_2, and 470_3, and the third transistors 480_1, 480_2, and 480_3 are substantially the same as the configurations of the second transistor 170 and the third transistor 180 of FIG. 4, the duplicated description will not be repeated.

The anode electrode 435_1 of the first pixel circuit 420 may be located in vicinity of the adjacent second pixel circuit 440. That is, the anode electrode 435_1 of the first pixel circuit 420 may be disposed over a pixel driving unit included in the second pixel circuit 440. Therefore, the capacitance of the parasitic capacitor CP2_1 formed between the anode electrode 435_1 of the first pixel circuit 420 and the electrode 495_2 of the adjacent second pixel circuit 440 is larger than the capacitance of the parasitic capacitor CP1_1 formed between the anode electrode 425_1 and the electrode 495_1 of the own first pixel circuit 420. Since the configuration of the anode electrodes 435_2 and 435_3 of the second pixel circuit 440 and the third pixel circuit 460 is similar to that of the anode electrode 435_1 of the first pixel circuit 420, the relationship between the capacitance of the parasitic capacitor CP2_2 and the capacitance of the parasitic capacitor CP1_2 and the relationship between the capacitance of the parasitic capacitor CP2_3 and the capacitance of the parasitic capacitor CP1_3 are similar to the relationship between the capacitance of the parasitic capacitor CP2_1 and the capacitance of the parasitic capacitor CP1_1. The anode electrodes 435_1, 435_2. 425_3 of the first, second, and third pixel circuits 420, 440, and 460 are spaced-apart from each other. An area overlapped by the first electrode 435_1 of the first pixel circuit 420 and the transistors of second pixel circuit 440 is greater than an area overlapped by the first electrode 435_1 of the first pixel circuit 420 and the transistors of the first pixel circuit 420. Although not shown in FIG. 7, each organic light emitting diode may also include a cathode electrode and an organic light emitting layer interposed between the anode electrode and the cathode electrode.

Figure 8A:
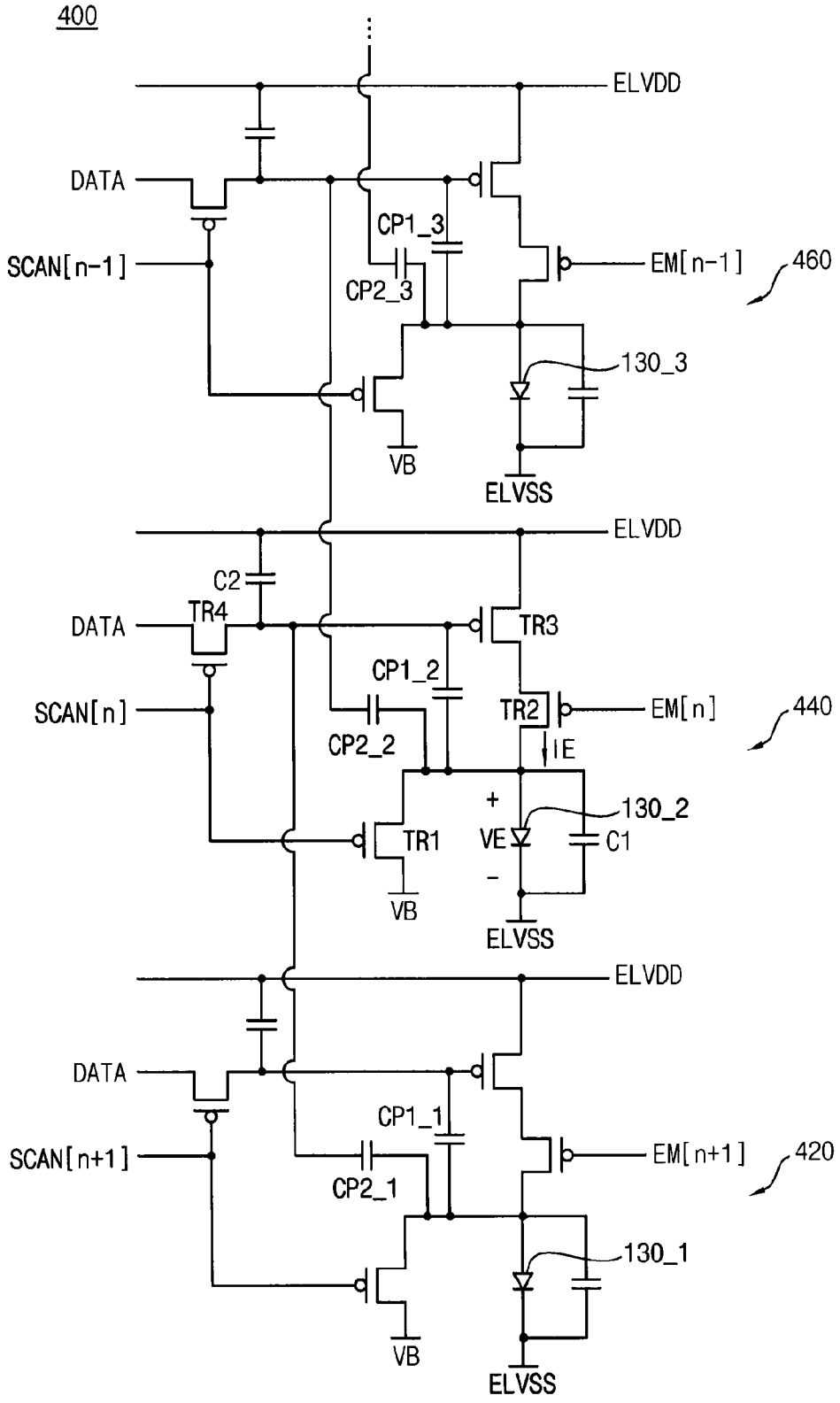
FIG. 8A is a circuit diagram illustrating an example where a parasitic capacitor of a pixel circuit is formed with an adjacent pixel circuit in a display panel of an organic light emitting display device of FIG. 6.
Figure 8B:
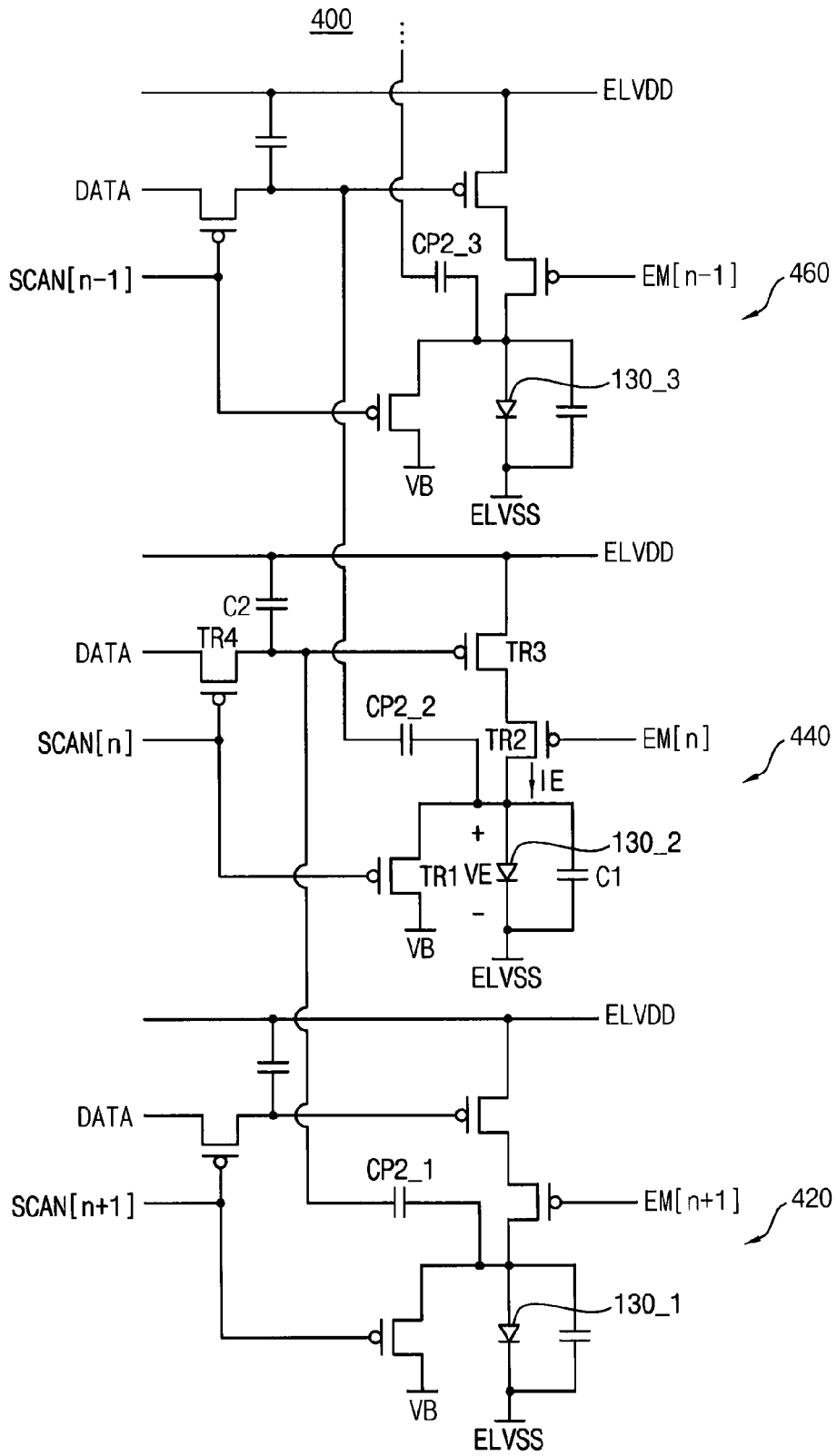
FIG. 8B is a simplified circuit diagram of FIG. 8A.
Figure 9:
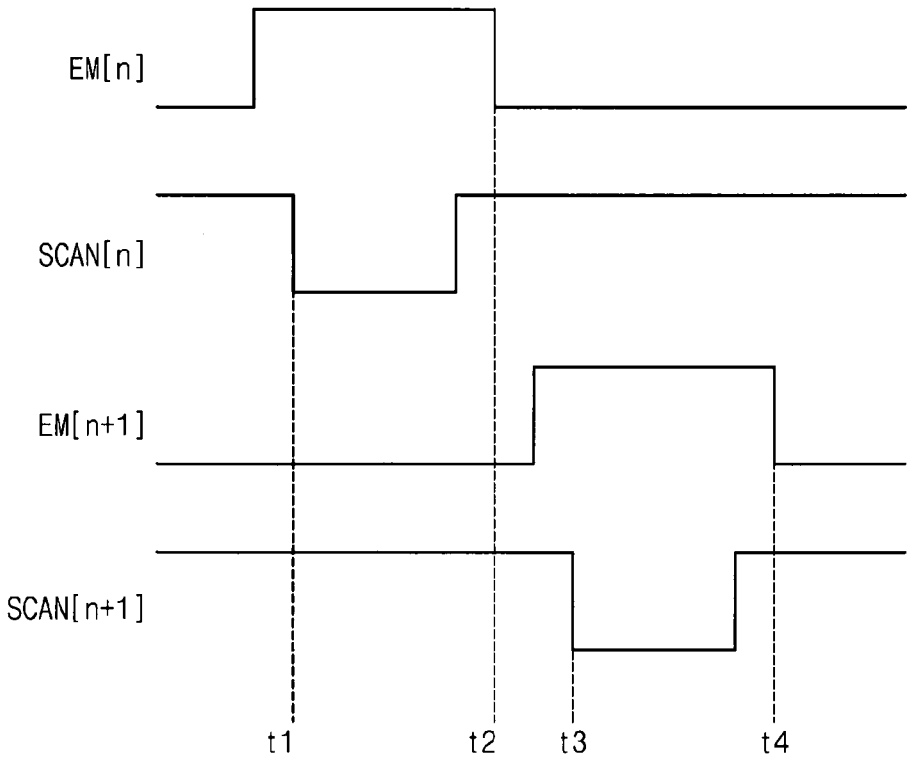
FIG. 9 is a timing diagram for describing an example of canceling a kickback voltage in a display panel of an organic light emitting display device of FIG. 8B.

FIG. 8A is a circuit diagram illustrating an example where a parasitic capacitance of a pixel circuit is formed with an adjacent pixel circuit in a display panel of an organic light emitting display device of FIG. 6. FIG. 8B is a simplified circuit diagram of FIG. 8A. FIG. 9 is a timing diagram for describing an example of canceling a kickback voltage in a display panel of an organic light emitting display device of FIG. 8B.

Referring to FIG. 8A, a display panel 400 of an organic light emitting display device may include a pixel circuit 460 coupled to an (n−1)th scan line, a pixel circuit 440 coupled to an nth scan line, and a pixel circuit 420 coupled to an (n+1)th scan line. Each pixel circuit 420, 440, and 460 may have a parasitic capacitor CP2_1, CP2_2, and CP2_3 with an adjacent pixel circuit as illustrated in FIG. 7. In addition, as shown in FIG. 8A, each pixel circuit 420, 440, and 460 may have a parasitic capacitor CP1_1, CP1_2, and CP1_3 with each own pixel circuit as illustrated in FIG. 7. Due to the configuration that the anode electrodes 435_1, 435_2, and 435_3 do not substantially overlap the electrodes 495_1, 495_2, and 495_3 of the same pixel circuit but substantially overlap one of the electrodes of the adjacent pixel circuits. The capacitance of the parasitic capacitor CP1_1, CP1_2, and CP1_3 is much smaller than the capacitance of the parasitic capacitor CP2_1, CP2_2, and CP2_3, respectively. Thus, the display panel 400 shown in FIG. 8A may be simplified to a display panel 400' shown in FIG. 8B by not displaying the parasitic capacitors CP1_1, CP1_2, and CP1_3 of FIG. 8A. The pixel circuits 420', 440', and 460' of FIG. 8B are simplified circuits of the pixel circuits 420, 440, and 460 of FIG. 8A.

Referring to FIG. 9, an nth emission signal EM[n], an nth scan signal SCAN[n], an (n+1)th emission signal EM[n+1], and an (n+1)th scan signal SCAN[n+1] are illustrated. The nth emission signal EM[n] and the nth scan signal SCAN[n] are supplied to the pixel circuit 440 coupled to the nth emission line and the nth scan line. The (n+1)th emission signal EM[n+1] and the (n+1)th scan signal SCAN[n+1] are supplied to the pixel circuit 420 coupled to the (n+1)th emission line and the (n+1)th scan line. A turn-on period of the nth scan signal SCAN[n] may start at t1, a turn-on period of the nth emission signal EM[n] may start at t2, a turn-on period of the (n+1)th scan signal SCAN[n+1] may start at t3, and a turn-on period of the (n+1)th emission signal EM[n+1] may start at t4.

When a voltage of an anode electrode of an organic light emitting diode 130_1 included in the pixel circuit 420 coupled to the (n+1)th scan line varies, a parasitic capacitance CP2_1 coupled to the anode electrode of the organic light emitting diode 130_1 may form a kickback voltage in a gate electrode of a third transistor TR3 included in the pixel circuit 440 coupled to the nth scan line.

A data signal DATA may be applied to the gate electrode of the third transistor TR3 via a data line at t1. The applied data signal DATA may be stored in a second capacitor C2.

The third transistor TR3 may apply an emission current IE or an emission voltage VE to the organic light emitting diode 130_2 to allow the organic light emitting diode 130_2 to emit light based on the data signal DATA stored in the second capacitor C2 at t2.

A bias voltage VB may be applied to the anode electrode of the organic light emitting diode 130_1 included in the pixel circuit 420 at t3. Thus, the voltage of the anode electrode may rapidly fall (e.g., from ELVSS+VEL to VB). The capacitance of the parasitic capacitor CP2_1 coupled to the anode electrode may form a kickback voltage VK1 in the gate electrode of the third transistor TR3 according to following [Equation 3].

$$VK1 = \frac{CP_{2_1}}{C_2 + CP_{2_1}} \times [VB - (ELVSS + VEL)] \quad \text{[Equation 3]}$$

Here, VK1 represents the kickback voltage, VEL represents a threshold voltage of the organic light emitting diode, $C_2$ represents the capacitance of the second capacitor C2, and $CP_{2_1}$ represents the capacitance of the parasitic capacitor CP2_1.

Finally, the voltage of the anode electrode of the organic light emitting diode 130_1 included in the pixel circuit 420' may rapidly rise (e.g., from VB to ELVSS+VEL) at t4. The parasitic capacitance CP2_1 coupled to the anode electrode may form a kickback voltage VK2 in the gate electrode of the third transistor TR3 according to following [Equation 4].

As a result, the kickback voltages formed at t3 and t4 may be offset each other, since VK1=−VK2. Accordingly, the influences of the kickback voltages on the data signal DATA may be minimized $$VK2 = \frac{CP_{2_}1}{C_2 + CP_{2_}1} \times [(ELVSS + VEL) - VB] \quad \text{[Equation 4]}$$

Here, VK2 represents the kickback voltage, VEL represents a threshold voltage of the organic light emitting diode, $C_2$ represents the capacitance of the second capacitor C2, and $CP_2_1$ represents the capacitance of the parasitic capacitor CP2_1.

Figure 10A:
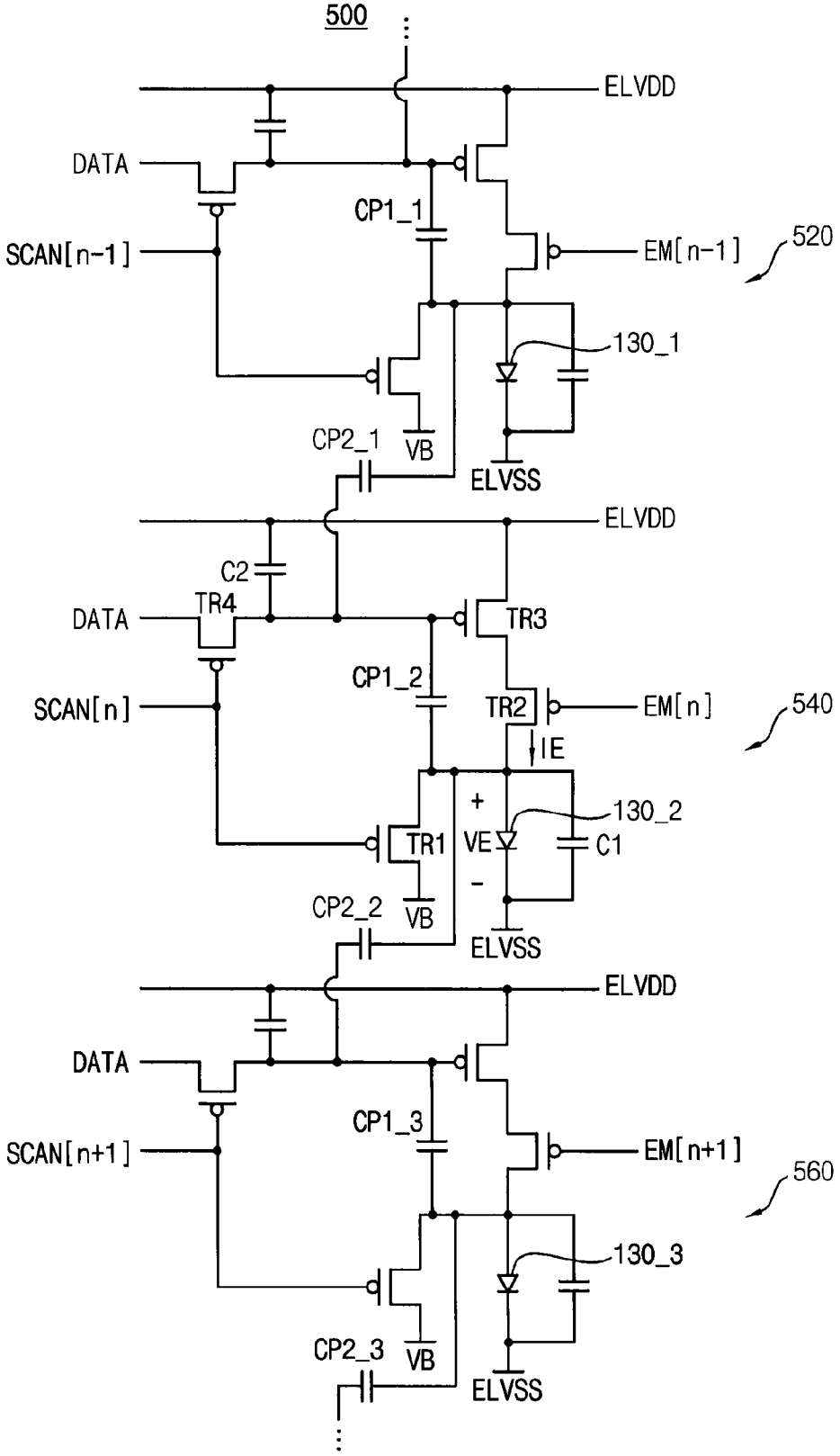
FIG. 10 is a circuit diagram illustrating another example where a parasitic capacitor of a pixel circuit is formed with an adjacent pixel circuit in a display panel of an organic light emitting display device of FIG. 6.
FIG. 10B is a simplified circuit diagram of FIG. 10A.
Figure 10B:
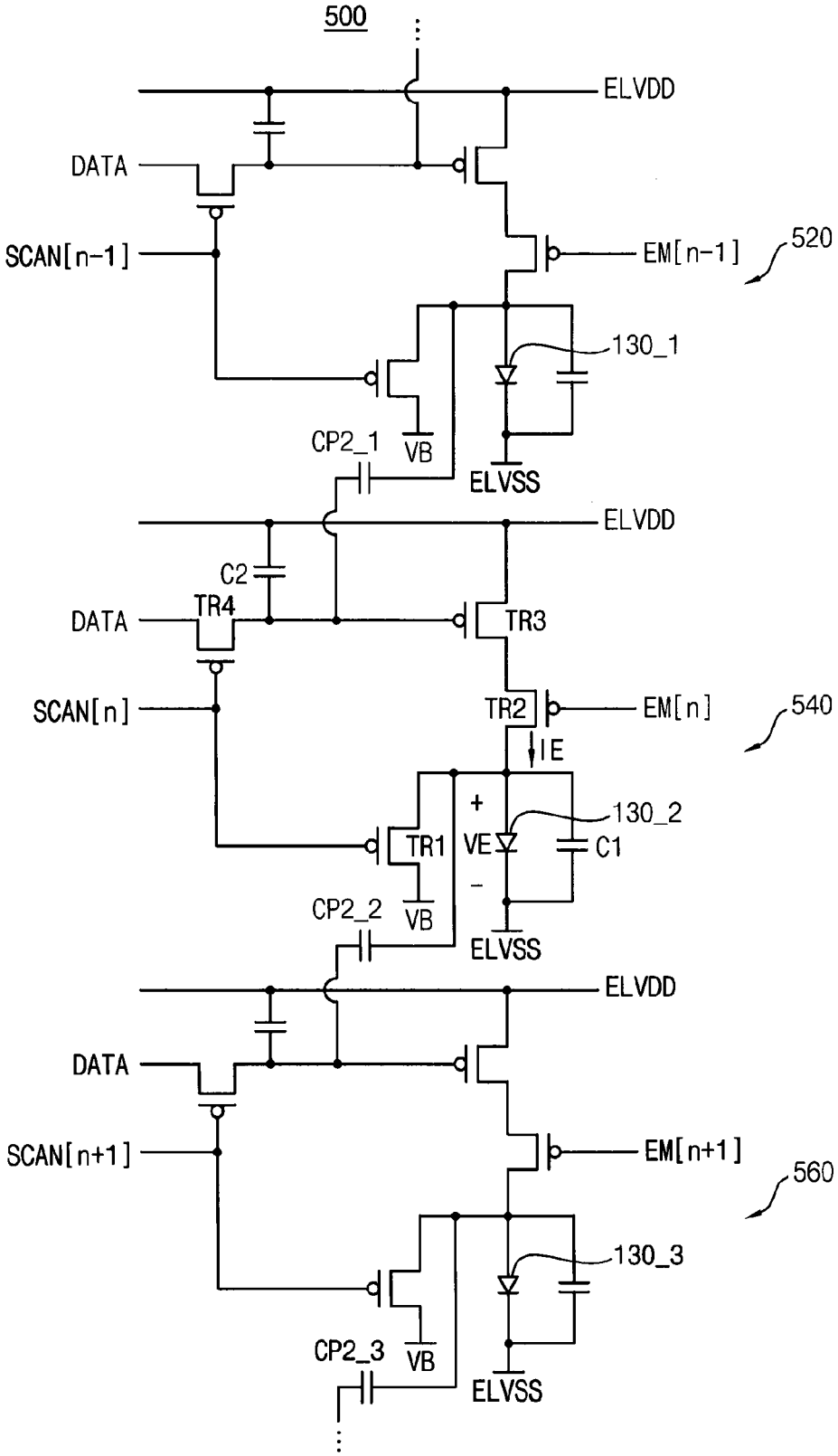
Figure 11:
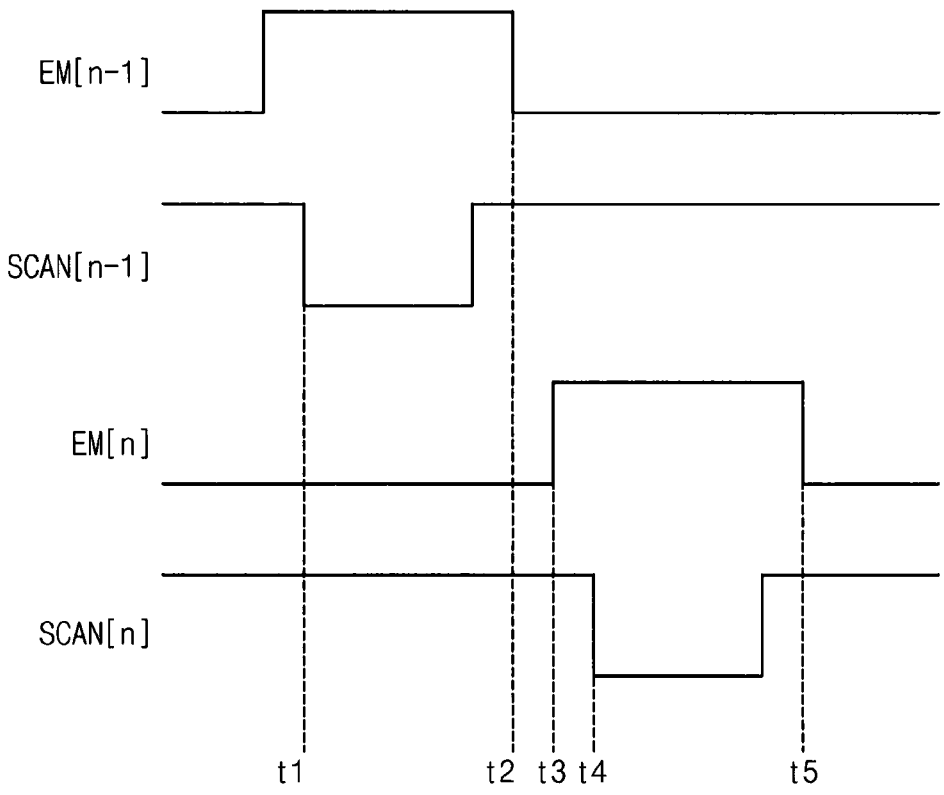
FIG. 11 is a timing diagram for describing an example of canceling a kickback voltage in a display panel of an organic light emitting display device of FIG. 10B.

FIG. 10A is a circuit diagram illustrating another example where a parasitic capacitor of a pixel circuit is formed with an adjacent pixel circuit in a display panel of an organic light emitting display device of FIG. 6. FIG. 10B is a simplified circuit diagram of FIG. 10B. FIG. 11 is a timing diagram for describing an example of canceling a kickback voltage in a display panel of an organic light emitting display device of FIG. 10.

Referring to FIG. 10A, a display panel 500 of an organic light emitting display device may include a pixel circuit 520 coupled to an (n−1)th scan line, a pixel circuit 540 coupled to an nth scan line, and a pixel circuit 560 coupled to an (n+1)th scan line. Each pixel circuit 520, 540, and 560 may have a parasitic capacitor CP2_1, CP2_2, and CP2_3 with an adjacent pixel circuit in a similar configuration illustrated in FIG. 7. In addition, as shown in FIG. 10A, each pixel circuit 520, 540, and 560 may have a parasitic capacitor CP1_1, CP1_2, and CP1_3 with each own pixel circuit as illustrated in FIG. 7. Due to the configuration that the anode electrodes 435_1, 435_2, and 435_3 do not substantially overlap the electrodes 495_1, 495_2, and 495_3 of the same pixel circuit but substantially overlap one of the electrodes of the adjacent pixel circuits. The capacitance of the parasitic capacitor CP1_1, CP1_2, and CP1_3 is much smaller than the capacitance of the parasitic capacitor CP2_1, CP2_2, and CP2_3, respectively. Thus, the display panel 500 shown in FIG. 10A may be simplified to a display panel 500' shown in FIG. 10B by not displaying the parasitic capacitors CP1_1, CP1_2, and CP1_3 of FIG. 10A. The pixel circuits 520', 540', and 560' of FIG. 10B are simplified circuits of the pixel circuits 520, 540, and 560 of FIG. 10A.

Referring to FIG. 11, an (n−1)th emission signal EM[n−1], an (n−1)th scan signal SCAN[n−1], an nth emission signal EM[n−1], and an nth scan signal SCAN[n] are illustrated. The (n−1)th emission signal EM[n−1] and the (n−1)th scan signal SCAN[n−1] are supplied to the pixel circuit 520 coupled to the (n−1)th emission line and the (n−1)th scan line. The nth emission signal EM[n] and the nth scan signal SCAN[n] are supplied to the pixel circuit 540 coupled to the nth emission line and the nth scan line. A turn-on period of the (n−1)th scan signal SCAN[n−1] may start at t1, a turn-on period of the (n−1)th emission signal EM[n−1] may start at t2, a turn-off period of the nth emission signal EM[n] may start at t3, a turn-on period of the nth scan signal SCAN[n] may start at t4, and a turn-on period of the nth emission signal EM[n] may start at t5.

When a voltage of an anode electrode of the organic light emitting diode 130_1 included in the pixel circuit 520 coupled to the (n−1)th scan line varies, a parasitic capacitance CP2_1 coupled to the anode electrode of the organic light emitting diode 130_1 may form a kickback voltage in a gate electrode of a third transistor TR3 included in the pixel circuit 540 coupled to the nth scan line.

A bias voltage VB may be applied to the anode electrode of the organic light emitting diode 130_1 included in the pixel circuit 520 at t1. Thus, the voltage of the anode electrode may rapidly fall (e.g., from ELVSS+VEL to VB). The parasitic capacitance CP2_1 coupled to the anode electrode may form a kickback voltage VK3 in the gate electrode of the third transistor TR3 according to following [Equation 5].

$$VK3 = \frac{CP_{2_}1}{C_2 + CP_{2_}1} \times [VB - (ELVSS + VEL)] \quad \text{[Equation 5]}$$

Here, VK3 represents the kickback voltage, VEL represents a threshold voltage of the organic light emitting diode, $C_2$ represents the capacitance of the second capacitor C2, and $CP_2_1$ represents the capacitance of the parasitic capacitor CP2_1.

The voltage of the anode electrode of the organic light emitting diode 130_1 included in the pixel circuit 520 may rapidly rise (e.g., from VB to ELVSS+VEL) at t2. The parasitic capacitance CP2_1 coupled to the anode electrode may form a kickback voltage VK4 in the gate electrode of the third transistor TR3 according to following [Equation 6]. As a result, the kickback voltages formed at t1 and t2 may be offset each other, since VK3=−VK4. Accordingly, the influences of the kickback voltages on the data signal DATA may be minimized $$VK4 = \frac{CP_{2_}1}{C_2 + CP_{2_}1} \times [(ELVSS + VEL) - VB] \quad \text{[Equation 6]}$$

Here, VK4 represents the kickback voltage, VEL represents a threshold voltage of the organic light emitting diode, $C_2$ represents the capacitance of the second capacitor C2, and $CP_2_1$ represents the capacitance of the parasitic capacitor CP2_1.

An organic light emitting diode 130_2 included in the pixel circuit 540' may stop emitting light at t3. In some example embodiments, the turn-on period of the nth emission signal EM[n] may end before the turn-on period of the (n−1)th scan signal SCAN[n−1]. In this case, while the data signal DATA is affected by the kickback voltages, the organic light emitting diode 130_2 may not emit light.

The data signal DATA may be applied to the gate electrode of the third transistor TR3 via a data line at t4. The applied data signal DATA may be stored in a second capacitor C2.

Finally, the third transistor TR3 may apply an emission current IE or an emission voltage VE to the organic light emitting diode 130_2 at t5. The organic light emitting diode 130_2 may emit light based on the data signal DATA stored in the second capacitor C2.

Figure 12:
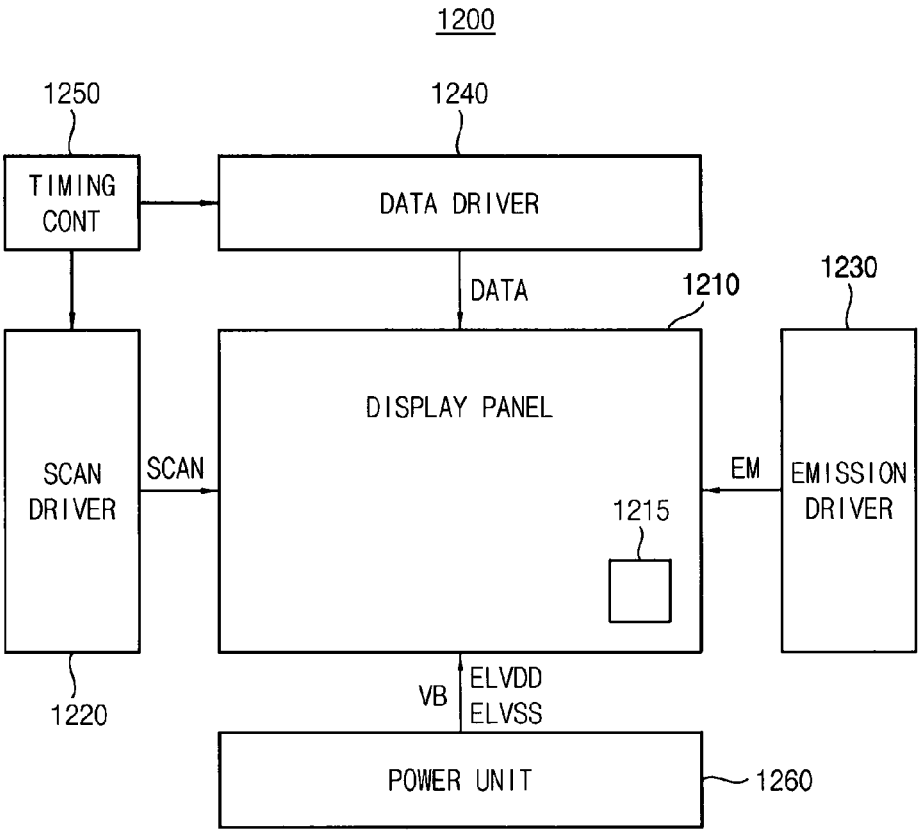
FIG. 12 is a block diagram illustrating an organic light emitting display device according to example embodiments.

FIG. 12 is a block diagram illustrating an organic light emitting display device according to example embodiments.

Referring to FIG. 12, an organic light emitting display device 1200 is illustrated. The organic light emitting display device 1200 may include a display panel 1210, a scan driver 1220, an emission driver 1230, a data driver 1240, and a timing controller 1250. According to some example embodiments, the organic light emitting display device 1200 may further include a power unit 1260. An organic light emitting diode of the organic light emitting display device 1200 may not emit light when a black data signal DATA is applied, and an influence of a kickback voltage may be minimized.

The display panel 1210 may include a plurality of pixel circuits 1215, scan lines, emission control lines, and data lines. Each of the pixel circuits 1215 may have an emission unit. The scan lines may be formed along the row direction to transmit a scan signal SCAN. The emission control lines may be formed along the row direction to transmit an emission signal EM. The data lines may be formed along the column direction to transmit a data signal DATA. The pixel circuits 1215 may store the data signal DATA based on the scan signal SCAN, and may emit light based on the stored data signal DATA and the emission signal EM. However, configurations and operations of the pixel circuits 1215 included in the display panel 1210 are substantially same as a configuration and an operation of a pixel circuit illustrated in FIG. 1 through FIG. 11, the duplicated description will not be repeated.

The scan driver 1220 coupled to the scan lines may apply the scan signal SCAN controlling the pixel circuits 1215 to the display panel 1210. Each of the pixel circuits 1215 may store the data signal DATA based on the scan signal SCAN. The data driver 1240 coupled to the data lines may apply the data signal DATA having emission information to pixel circuits 1215. The timing controller 1250 may control driving timings of the scan driver 1220 and the data driver 1240. Further, the timing controller 1250 may control driving timings of the emission driver 1230. The emission driver 1230 coupled to the emission lines may apply the emission signal EM to the display panel 1210. The pixel circuits 1215 may emit light based on the emission signal EM. The power unit 1260 may apply a first power supply voltage ELVSS, a second power supply voltage ELVDD, and a bias voltage VB to each of the pixel circuits 1215.

Figure 13:
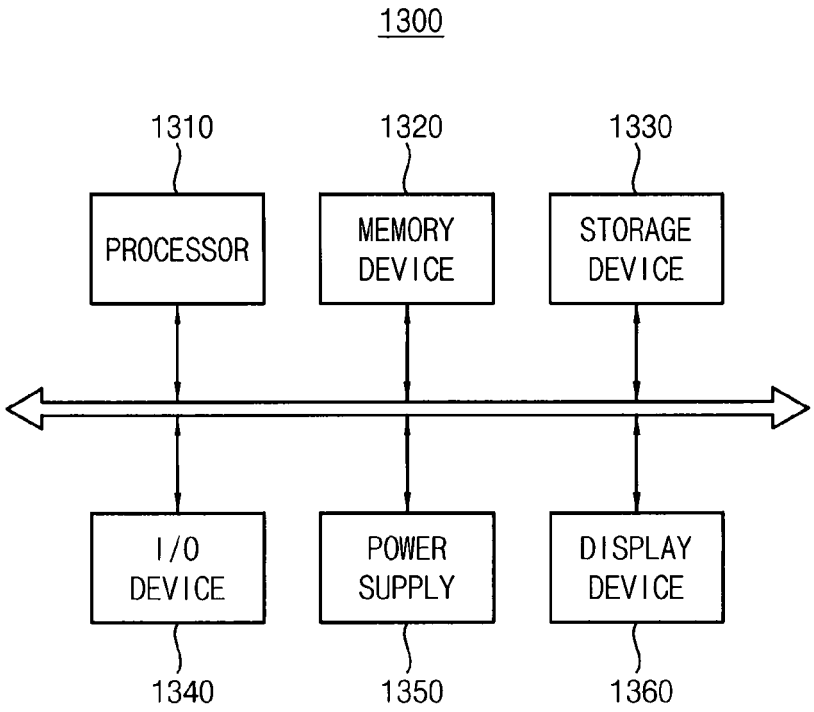
FIG. 13 is a block diagram illustrating an electronic system including an organic light emitting display device according to example embodiments.

FIG. 13 is a block diagram illustrating an electronic system including an organic light emitting display device according to example embodiments.

Referring to FIG. 13, an electronic system 1300 includes a processor 1310, a memory device 1320, a storage device 1330, an input/output (I/O) device 1340, a power supply 1350, and an organic light emitting display device 1360. The electronic system 1300 may further include a plurality of ports for communicating a video card, a sound card, a memory card, a universal serial bus (USB) device, other electronic systems, etc.

The processor 1310 may perform various computing functions or tasks. The processor 1310 may be for example, a microprocessor, a central processing unit (CPU), etc. The processor 1310 may be connected to other components via an address bus, a control bus, a data bus, etc. Further, the processor 1310 may be coupled to an extended bus such as a peripheral component interconnection (PCI) bus.

The memory device 1320 may store data for operations of the electronic system 1300. For example, the memory device 1320 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1330 may be, for example, a solid state drive (SSD) device, a hard disk drive (HDD) device, a CD-ROM device, etc. The I/O device 1340 may be, for example, an input device such as a keyboard, a keypad, a mouse, a touch screen, etc, and/or an output device such as a printer, a speaker, etc. The power supply 1350 may supply power for operations of the electronic system 1300. The organic light emitting display device 1360 may communicate with other components via the buses or other communication links.

The organic light emitting display device 1360 may include a display panel having pixel circuits, a scan driver, an emission driver, a data driver, and a timing controller. Each of the pixel circuits may include an emission unit, a pixel driving unit, and a switch unit. A first parasitic capacitance between the emission unit included in a first pixel circuit of the pixel circuits and the pixel driving unit included in the first pixel circuit may be smaller than a second parasitic capacitance between the emission unit included in the first pixel circuit and the pixel driving unit included in a second pixel circuit of the pixel circuits adjacent to the first pixel circuit.

In one example embodiment, the second pixel circuit may be located in a first direction from the first pixel circuit, and the first direction is a direction in which the scan signal is sequentially applied to scan lines.

In another example embodiment, the second pixel circuit may be located in a second direction from the first pixel circuit, and the second direction is opposite to a direction in which the scan signal is sequentially applied to scan lines.

The present embodiments may be applied to any electronic system 1300 having the organic light emitting display device 1360. For example, the present embodiments may be applied to the electronic system 1300, such as a television, a computer monitor, a laptop, a digital camera, a cellular phone, a smart phone, a personal digital assistant (PDA), a portable multimedia player (PMP), a MP3 player, a navigation system, a video phone, etc.

The foregoing is illustrative of example embodiments, and is not to be construed as limiting thereof. Although a few example embodiments have been described, those skilled in the art will readily appreciate that many modifications are possible in the example embodiments without materially departing from the novel teachings and advantages of example embodiments. Accordingly, all such modifications are intended to be included within the scope of example embodiments as defined in the claims. In the claims, means-plus-function clauses are intended to cover the structures described herein as performing the recited function and not only structural equivalents but also equivalent structures. Therefore, it is to be understood that the foregoing is illustrative of example embodiments and is not to be construed as limited to the specific embodiments disclosed, and that modifications to the disclosed example embodiments, as well as other example embodiments, are intended to be included within the scope of the appended claims. The inventive concept is defined by the following claims, with equivalents of the claims to be included therein.

What is claimed is:

1. A display panel of an organic light emitting display device, the display panel including a plurality of pixel circuits, each of the pixel circuits comprising:

an emission unit including an organic light emitting diode;

a pixel driving unit configured to drive the emission unit based on a scan signal and a data signal; and a switch unit configured to control an electrical connection between the emission unit and the pixel driving unit based on an emission signal, a capacitance of a first parasitic capacitor coupled between the emission unit included in a first pixel circuit of the pixel circuits and the pixel driving unit included in the first pixel circuit being smaller than a capacitance of a second parasitic capacitor coupled between the emission unit included in the first pixel circuit and the pixel driving unit included in a second pixel circuit of the pixel circuits adjacent to the first pixel circuit, wherein the emission unit comprises:

the organic light emitting diode having a first electrode coupled to the switch unit, and a second electrode coupled to a first power supply voltage;

a first transistor having a gate electrode receiving the scan signal, a first electrode coupled to the first electrode of the organic light emitting diode, and a second electrode coupled to a bias voltage; and a first capacitor having a first electrode coupled to the first electrode of the organic light emitting diode, and a second electrode coupled to the second electrode of the organic light emitting diode, wherein the switch unit comprises:

a second transistor having a gate electrode receiving the emission signal, a first electrode coupled to the pixel diving unit, and a second electrode coupled to the emission unit, and wherein the first capacitor stores the bias voltage when the second transistor electrically separates the emission unit from the pixel driving unit during a turn-off period of the emission signal.

2. The display panel of claim 1, wherein a first electrode of the organic light emitting diode included in the first pixel circuit is disposed over the pixel driving unit included in the second pixel circuit, and wherein the first electrodes of the organic light emitting diodes of the emission units of the plurality of pixel circuits are disposed spaced apart from each other.

3. The display panel of claim 1, wherein the second pixel circuit is located in a first direction from the first pixel circuit, and the first direction is opposite to a direction in which the scan signal is sequentially applied to scan lines of the plurality of pixel circuits.

4. The display panel of claim 1, wherein the second pixel circuit is located in a second direction from the first pixel circuit, and the second direction is a direction in which the scan signal is sequentially applied to scan lines of the plurality of pixel circuits.

5. The display panel of claim 1, wherein:

the first transistor applies the bias voltage to the first electrode of the organic light emitting diode during a turn-on period of the scan signal, and the first capacitor stores the bias voltage applied to the first electrode of the organic light emitting diode during the turn-on period of the scan signal.

6. The display panel of claim 5, wherein, when the data signal representing a black gray level is applied to the pixel driving unit during the turn-on period of the scan signal, the emission unit allows a current leaked from the pixel driving unit to flow through the first transistor during a turn-on period of the emission signal.

7. The display panel of claim 6, wherein the bias voltage has a voltage level set for the organic light emitting diode not to emit light by the leaked current during the turn-on period of the emission signal.

8. The display panel of claim 1, wherein the pixel driving unit comprises:

a second capacitor having a first electrode coupled to a second power supply voltage, and a second electrode;

a third transistor having a gate electrode coupled to the second electrode of the second capacitor, a first electrode coupled to the second power supply voltage, and the second electrode coupled to the switch unit; and a fourth transistor having a gate electrode receiving the scan signal, a first electrode receiving the data signal, and a second electrode coupled to the gate electrode of the third transistor.

9. The display panel of claim 8, wherein:

the first parasitic capacitor is a parasitic capacitor formed between the first electrode of the organic light emitting diode included in the first pixel circuit and the gate electrode of the third transistor included in the first pixel circuit, and the second parasitic capacitor is a parasitic capacitor formed between the first electrode of the organic light emitting diode included in the first pixel circuit and the gate electrode of the third transistor included in the second pixel circuit.

10. The display panel of claim 8, wherein the fourth transistor applies the data signal to the second electrode of the second capacitor during a turn-on period of the scan signal, and the second capacitor stores the applied data signal.

11. The display panel of claim 10, wherein the pixel driving unit comprises:

a current source configured to supply an emission current, the current source having a first electrode coupled to the second power supply voltage and a second electrode, and a first electrode of the third transistor is coupled to the second electrode of the current source.

12. An organic light emitting display device, comprising:

a display panel including a plurality of pixel circuits;

a scan driver configured to apply a scan signal to the pixel circuits;

an emission driver configured to apply an emission signal to the pixel circuits;

a data driver configured to apply a data signal to the pixel circuits; and a timing controller configured to control the scan driver, the emission driver, and the data driver, each of the pixel circuits comprising:

an emission unit including an organic light emitting diode;

a pixel driving unit configured to drive the emission unit based on the scan signal and the data signal; and a switch unit configured to control an electrical connection between the emission unit and the pixel driving unit based on the emission signal, a capacitance of a first parasitic capacitor between the emission unit included in a first pixel circuit of the pixel circuits and the pixel driving unit included in the first pixel circuit, being smaller than a capacitance of a second parasitic capacitor between the emission unit included in the first pixel circuit and the pixel driving unit included in a second pixel circuit of the pixel circuits adjacent to the first pixel circuit, wherein the emission unit comprises:

the organic light emitting diode having a first electrode coupled to the switch unit, and a second electrode coupled to a first power supply voltage;

a first transistor having a gate electrode receiving the scan signal, a first electrode coupled to the first electrode of the organic light emitting diode, and a second electrode coupled to a bias voltage; and a first capacitor having a first electrode coupled to the first electrode of the organic light emitting diode, and a second electrode coupled to the second electrode of the organic light emitting diode, wherein the switch unit comprises:

a second transistor having a gate electrode receiving the emission signal, a first electrode coupled to the pixel diving unit, and a second electrode coupled to the emission unit, and wherein the first capacitor stores the bias voltage when the second transistor electrically separates the emission unit from the pixel driving unit during a turn-off period of the emission signal.

13. The organic light emitting display device of claim 12, wherein:

a first electrode of the organic light emitting diode included in the first pixel circuit is disposed over the pixel driving unit included in the second pixel circuit, and the first electrodes of the organic light emitting diodes of the emission units of the plurality of pixel circuits are disposed spaced-apart from each other.

* * * * *